US005207271A

United States Patent [19]

Sanchez et al.

[11] Patent Number: 5,207,271

[45] Date of Patent: May 4, 1993

[54] FOAM/STEAM INJECTION INTO A HORIZONTAL WELLBORE FOR MULTIPLE FRACTURE CREATION

[75] Inventors: J. Michael Sanchez; Bassem R. Alameddine, both of Carrollton, Tex.

[73] Assignee: Mobil Oil Corporation, Fairfax, Va.

[21] Appl. No.: 784,956

[22] Filed: Oct. 30, 1991

[51] Int. Cl.[5] ..... E21B 43/24; E21B 43/267

[52] U.S. Cl. ..... 166/281; 166/50; 166/303; 166/308; 166/309

[58] Field of Search ..... 166/50, 281, 294, 303, 166/308, 309

[56] References Cited

U.S. PATENT DOCUMENTS

| | | | |
|---|---|---|---|
| 3,739,852 | 6/1973 | Woods et al. | 166/308 X |
| 3,937,283 | 2/1976 | Blauer et al. | 166/307 |
| 3,993,133 | 11/1976 | Clampitt | 166/272 |
| 4,445,573 | 5/1984 | McCaleb | 166/309 X |
| 4,453,596 | 6/1984 | Conway et al. | 166/278 |
| 4,470,462 | 9/1984 | Hutchinson | 166/292 |
| 4,665,982 | 5/1987 | Brown | 166/308 X |
| 4,951,751 | 8/1990 | Jennings, Jr. | 166/50 X |
| 5,005,645 | 4/1991 | Jennings, Jr. et al. | 166/308 X |
| 5,074,360 | 12/1991 | Guinn | 166/50 X |
| 5,085,276 | 2/1992 | Rivas et al. | 166/50 X |

*Primary Examiner*—George A. Suchfield

*Attorney, Agent, or Firm*—A. J. McKillop; G. W. Hager; C. A. Malone

[57] ABSTRACT

A foam/steam injection method for forming fractures is a for reservoir penetrated by a horizontal wellbore. Steam is injected into said wellbore at a pressure sufficient to fracture the formation. Water which is used to make the steam contains a foamable composition in an amount sufficient to make a foam upon contact with steam. Steam and foam enter the wellbore and create a fracture in an oil-rich zone. Thereafter, foam blocks further steam entry into the created fracture which causes another fracture to form at a second interval along the horizontal wellbore. These steps are repeated until a fracture system is made along the length of the wellbore.

9 Claims, 3 Drawing Sheets

FOAM/STEAM INJECTION INTO A HORIZONTAL WELLBORE FOR MULTIPLE FRACTURE CREATION

FIELD OF THE INVENTION

This invention relates to a foam/steam method for producing viscous petroleum crude from a formation penetrated by a horizontal wellbore. More particularly, it is directed to a method for treating a subsurface permeable formation so as to create additional fractures along a horizontal wellbore during a foam/steam injection process to improve the efficiency for the removal of said crude.

BACKGROUND OF THE INVENTION

Hydraulic fracturing with foam fluids or "foam fracturing" is described in U.S. Pat. No. 3,937,283. This process involves the generation of a foam of a desired quality. Various gases and liquids may be used to create the foam, but the usual foams are made from nitrogen or carbon dioxide and water in the presence of a suitable foaming agent. The foam is pumped into the formation at a temperature and pressure sufficient to cause a fracture in the subterranean formation.

Fracturing caused by a foam fracturing process is effective and has advantages over the known prior art methods. For example, foam fracturing can be carried out without significant fluid loss in comparison to treatments utilizing unfoamed liquids. Additionally, foam comes out of the well easily when pressure is removed from the wellhead, because of the expansion of the foam when the pressure is released.

In fracturing operations, as disclosed by Conway et al. in U.S. Pat. No. 4,453,596, a gelled foam fluid is injected into a wellbore under sufficient pressure to create at least one fracture in a subterranean formation. An additional quantity is pumped into the formation after creation of the fracture to extend the length of the fracture. Thereafter, pressure applied to the fluid is reduced whereby said foam is caused to collapse and deposit into the fracture a particulate present in the fluid thereby propping the fracture.

Long horizontal wells are increasingly becoming common in steam operations in heavy oil reservoirs. Non-uniform distribution of heat due to reservoir heterogeneities and pressure drop within the well, commonly results in poor oil production.

Therefore, what is needed is a foam/steam injection method for fracturing a formation containing a horizontal wellbore so as to obtain sequential fractures along its length and uniform heating along said wellbore.

SUMMARY

In the practice of this invention, a foamable composition is injected into a horizontal wellbore in an admixture with steam injection so as to cause a foam to form in the wellbore. The foam then enters an existing fracture or a created fracture. Once foam has entered into the wellbore, steam injection pressure causes the foam to enter a fracture and close off that fracture thereby precluding additional steam entry into said fracture. Closing off the fracture by the foam causes an increase in steam pressure within the horizontal wellbore which causes another fracture to form at a different interval along said wellbore. Foam injection is ceased while steam injection continues for heating formation or reservoir area adjacent to the fracture. Once the area has been heated to the extent desired, steam injection is ceased and hydrocarbonaceous fluids removed from that area. The foam and steam injection process can be recommenced so as to close that fracture with foam. Closing that fracture with foam causes the foam to move to a different interval in the wellbore and create another fracture. This process can be continued until the formation encompassing the horizontal wellbore has been fractured and depleted of the desired volume of hydrocarbonaceous fluids.

Alternatively, the wellbore can be fractured to the extent desired along the wellbore until such time as it is desired to initiate a thermal or steam injection process so as to remove hydrocarbonaceous fluids from the wellbore.

It is therefore an object of this invention to form multiple fractures along a horizontal wellbore so as to contact a reservoir's pay zone and obtain more efficient reservoir heating for the removal of hydrocarbonaceous fluids.

It is another object of this invention to form a series of perpendicular fractures along the length of a horizontal wellbore by coinjecting steam and foam at formation fracturing pressures.

It is still yet another object of this invention to have a process for forming multiple fractures along a horizontal wellbore either continuously or cyclically via a foam/steam injection fracturing method.

DESCRIPTION OF THE PREFERRED EMBODIMENTS

In the practice of this invention, steam and foam are coinjected into a horizontal wellbore which penetrates a hydrocarbonaceous fluid containing formation or reservoir. As the foam and steam enter the wellbore at pressure above the fracturing pressure of the formation, a fracture is created along the horizontal wellbore into the formation. Foam then enters the created fracture, thereby filling it. Once the fracture has been filled with foam, fracturing pressure in the wellbore begins to increase due to increased flow resistance in the first fracture, thereby creating a second fracture.

Figure 1:
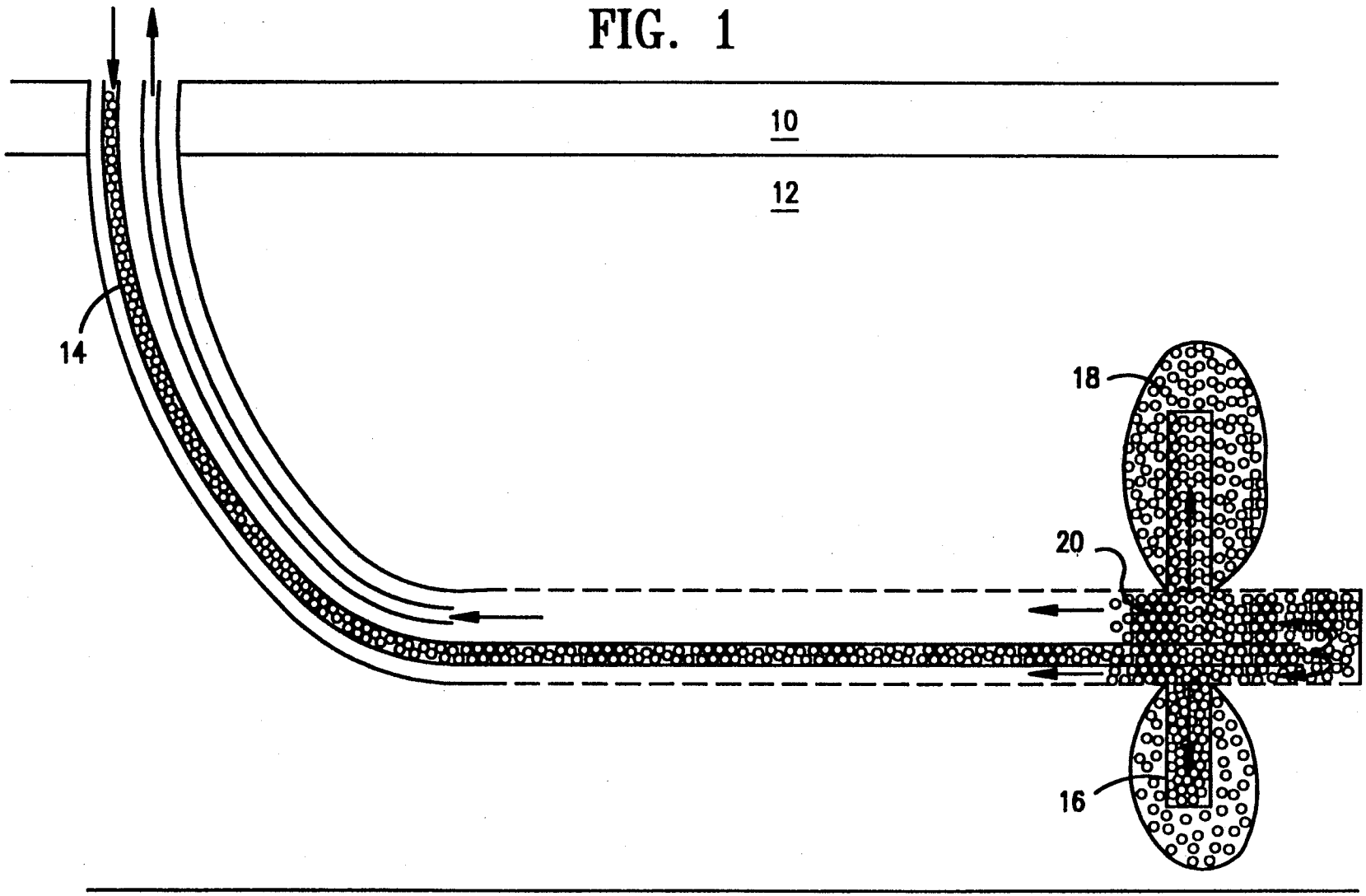
FIG. 1 is a schematic drawing which shows the formation of a reservoir fracture via steam injection.

This is shown in FIG. 1 wherein steam and foam enter injection tubing 14 located within the closed wellbore which has penetrated overburden 10 and an oil or hydrocarboneaceous fluid containing zone 12. As pressure increases within the horizontal wellbore, a first fracture 16 forms along the horizontal wellbore. As those skilled in the art will recognize, the fracture which forms is a function of the overburden pressure as well as other pressures within the formation. However, it is anticipated that at the depths which the horizontal wellbore will penetrate an oil-rich zone 12, the pressures existing therein will be such as to create vertical fractures which will most likely form perpendicular to the horizontal well. Methods for fracturing a formation where foams have been used are known to those skilled in the art. One such method is disclosed by Conway et al. in U.S. Pat. No. 4,453,596. This patent is hereby incorporated by reference herein.

Figure 2:
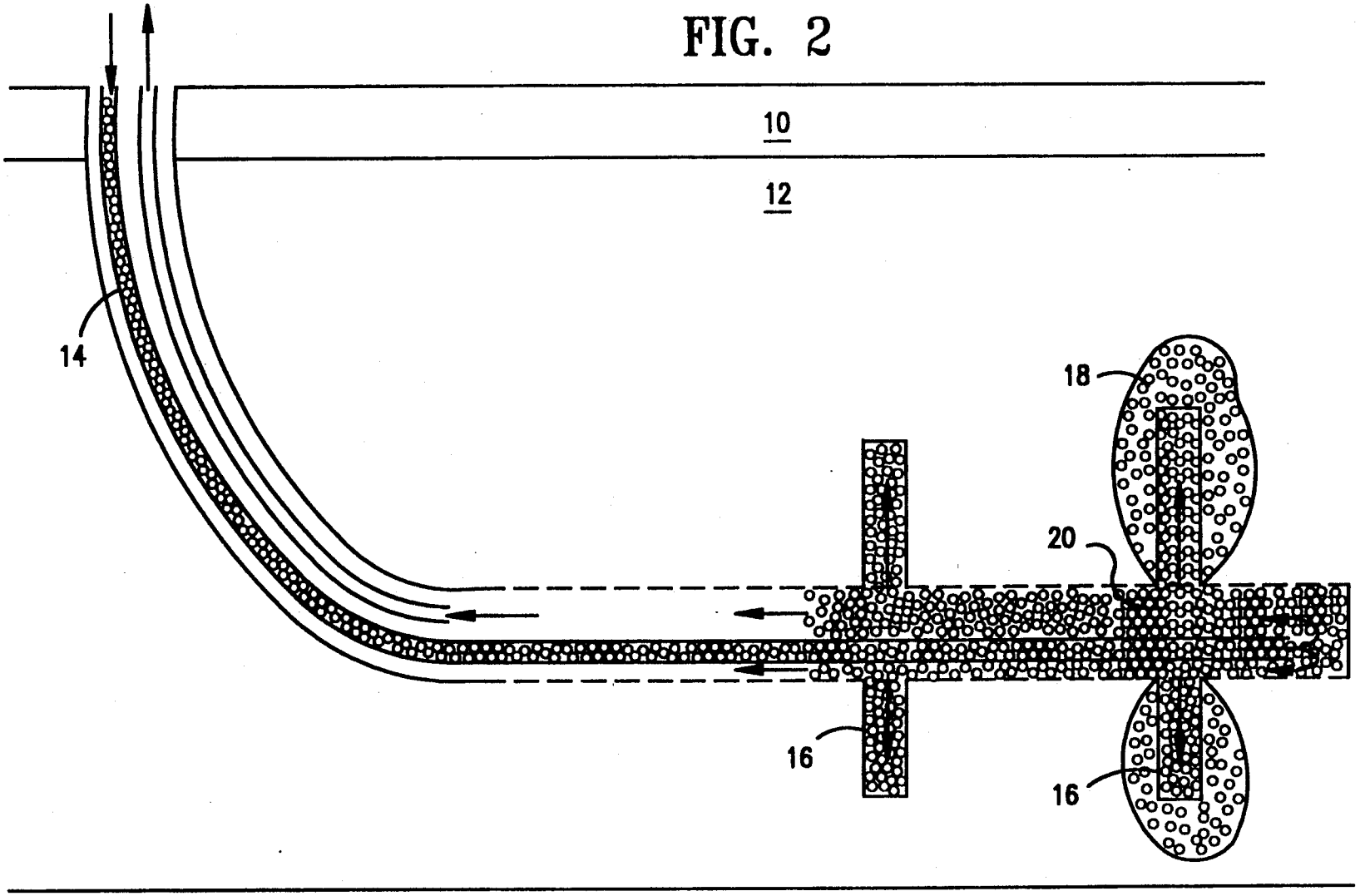
FIG. 2 is a schematic drawing of a horizontal wellbore wherein a fracture has been produced and subsequently filled with foam thereby creating a second fracture along the wellbore.

While foam and steam are entering fracture 16, a heated zone 18 is created around fracture 16. As shown in FIG. 2, foam continues to enter first fracture 16 and foam 20 begins to fill fracture 16 and heated zone 18, thereby blocking that zone. Once first fracture 16 and heated zone 18 have been filled with foam and steam, pressure within the wellbore begins to rise due to increased flow resistance in first fracture 16. As the pressure continues to rise, another fracture 16 is formed at a different internal along the horizontal wellbore. Perforations (not shown) can be made along horizontal the wellbore to control where fracturing occurs.

Figure 3:
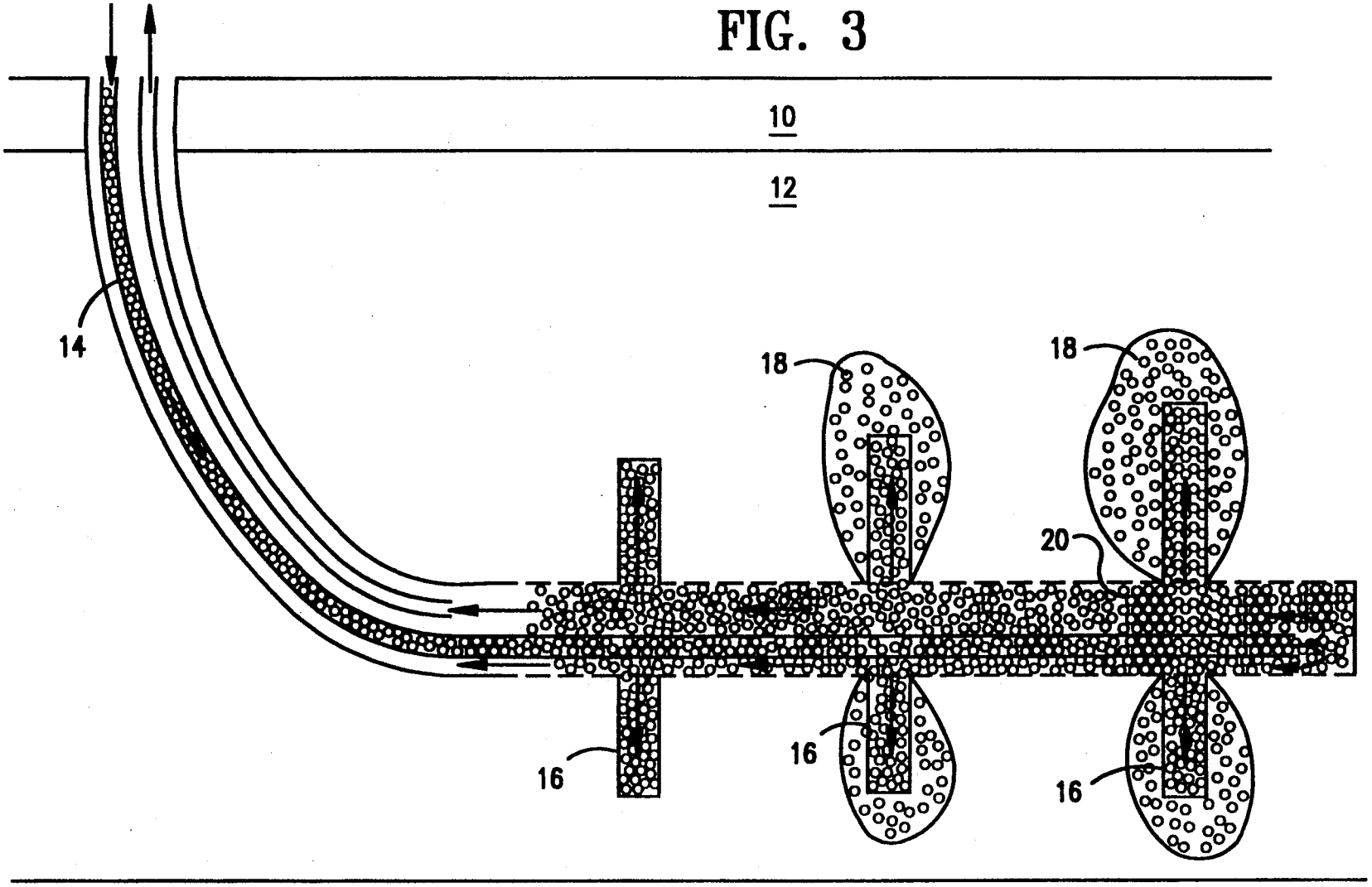
FIG. 3 is a schematic representation of a wellbore penetrating a formation wherein two fractures have been formed and filled with foam, thereby causing a third fracture to be created.

Steam and foam are continuously injected into injection tubing 14 so as to form first, second and third fractures. The creation of these additional fracture is shown in FIG. 3. These fractures are formed by repeating the process as mentioned above until a desired number of fractures have been created.

Methods for making and utilizing foam are disclosed in U.S. Pat. Nos. 4,453,596, 4,470,462, and 3,993,133 which issued to Conway et al, on Jun. 12, 1984, Hutchinson on Sep. 11, 1984, and Clampitt on Nov. 23, 1976, respectively. A steam foam process is disclosed by Muijs et al, in U.S. Pat. No. 4,693,311 which issued on Sep. 15, 1987. These patents are hereby incorporated by reference herein.

Thermally stable surfactant systems such as comprising linear toluene sulfonates are commercially available. These surfactant systems can satisfy the requirements of foam stability at high temperatures of about 450° F. One such system which can be utilized herein is Chaser ®SD1020 stable surfactant which is marketed by Chevron. This formulation contains 0.5 wt. % of active surfactant which is injected with water to make steam. Additionally, it contains about 0.5 to 0.17 mole fraction nitrogen when mixed with steam of 88% quality. Another stable surfactant system which can be used herein is marketed by Shell under the trade name LTS ®18. When making foam for injection with the steam in this process, 0.5 wt. % of the active surfactant is placed into water which will be used to make the steam. During the injection period, the steam is mixed with 0.05 to about 0.17 mole fraction of nitrogen. The steam which is injected along with the surfactant has a steam quality of about 80%.

Should it be desired to prop the formation, the method as disclosed by Hutchinson in U.S. Pat. No. 4,470,462 can be used to inject a particulate matter along with the foam and steam. Once the particulate matter and foam enter the formation, a propped fracture is formed once the foam collapses.

In another embodiment, instead of continuously coinjecting foam and steam together into the wellbore to form a number of fractures uninterruptedly, steam can be injected along the with the foam and a first fracture made. Pressure can then be released on the formation thereby causing the foam to collapse. Thereafter, steam alone can be injected into the formation so as to heat the formation through the fracture which was formed. Hydrocarbonaceous fluids can then be removed from the formation, and produced to the surface. Thereafter, foam and steam can be injected into the formation, thereby closing the first formed fracture and creating a second fracture. Steam can then be injected into the second fracture while foam precludes steam entry into the first fracture. Coinjection of foam with steam is then ceased and steam injection along is continued into the second foam fracture until the area or zone around that fracture is heated to a desired temperature sufficient to remove hydrocarbonaceous fluids or oil from the zone of interest. Hydrocarbonaceous fluids or oil are then produced to the surface by the wellbore. These steps can be repeated until fractures have been formed along the horizontal wellbore to the extent desired and hydrocarbonaceous fluids removed from the zones adjacent to said wellbore.

Although the present invention has been described with preferred embodiments, it is to be understood that modifications and variations may be resorted to without departing from the spirit and scope of this invention as those skilled in the art will readily understand. Such modifications and variations are considered to be within the purview and scope of the appended claims.

What is claimed:

1. A foam and steam injection method for forming a fracture in a formation or reservoir penetrated by a horizontal wellbore comprising:

a) injecting steam into said wellbore at a pressure sufficient to fracture said formation where water used to form said steam contains a foamable composition in an amount sufficient to make a foam upon contact with said steam; and b) fracturing said formation with said steam and foam thereby causing a fracture to form whereupon the foam enters said fracture thereby precluding further steam entry into said fracture.

2. The method as recited in claim 1 where steps a) and b) are repeated without releasing fracturing pressure until a desired number of fractures have been formed along said wellbore.

3. The method as recited in claim 1 where a particular matter is placed into said foamable composition which matter is deposited into said fracture thereby propping it when pressure is released on the wellbore.

4. The method as recited in claim 1 where said foamable composition comprises a gel and a surfactant.

5. The method as recited in claim 1 where steps a) and b) are repeated after releasing fracturing pressure on said wellbore until a desired number of fractures have been formed along said wellbore.

6. The method as recited in claim 1 where steps a) and b) are repeated after releasing fracturing pressure on said wellbore until a desired number of fractures have been formed along said wellbore, the formation heated, and a desired volume of hydrocarbonaceous fluids are removed from the formation.

7. A steam and foam injection method for forming multiple fractures in a formation or reservoir penetrated by a horizontal wellbore comprising:

a) injecting steam into said wellbore at a rate and pressure sufficient to fracture said formation;

b) allowing said steam to remain in said formation for a time sufficient to heat hydrocarbonaceous fluids therein via a fracture resultant from step a) so as to cause said fluids to flow from said formation into said wellbore;

c) removing said fluids from said wellbore to the surface;

d) thereafter injecting steam into said formation via said wellbore at a pressure sufficient to fracture said formation where water used to form said steam contains a foamable composition in an amount sufficient to make a foam upon contact with said steam; and e) causing said steam and foam to enter the fracture thereby blocking it against further steam entry whereupon said steam and foam cause a fracture to form at a different interval along said wellbore.

8. The method as recited in claim 7 where after step e), steps c(, d), and e) are repeated until a desired volume of hydrocarbonaceous fluids have been removed from said formation.

9. A foam and steam injection method for forming multiple fractures in a formation or reservoir penetrated by a horizontal wellbore comprising:

a) injecting steam into said wellbore at a pressure sufficient to fracture said formation where water used to make said steam contains a foamable composition in an amount sufficient to make a foam upon contact with said steam where thereafter said foam enters an existing fracture, thereby precluding further steam entry therein which causes another fracture to form at another interval along said wellbore.

* * * * *

UNITED STATES PATENT AND TRADEMARK OFFICE

CERTIFICATE OF CORRECTION

PATENT NO. : 5,207,271

DATED : May 4, 1993

INVENTOR(S) : J. Michael Sanchez and Bassem R. Alameddine

It is certified that error appears in the above-identified patent and that said Letters Patent is hereby corrected as shown below:

Col. 4, line 38: "particular" should be --particulate--.

Abstract, line 1: after "fractures", "is" should be --in--.

Signed and Sealed this

Fourth Day of January, 1994

*Attest:*

*Attesting Officer*

BRUCE LEHMAN

*Commissioner of Patents and Trademarks*